United States Patent [19]

Cho

[11] Patent Number: 5,015,911

[45] Date of Patent: May 14, 1991

[54] MULTISTEP FOCUSING ELECTRON GUN FOR CATHODE RAY TUBE

[75] Inventor: Seog-lae Cho, Suwon, Rep. of Korea

[73] Assignee: Samsung Electron Devices Ltd., Seoul, Rep. of Korea

[21] Appl. No.: 349,589

[22] Filed: May 9, 1989

[30] Foreign Application Priority Data

Nov. 17, 1988 [KR] Rep. of Korea ..... 88-15132
Mar. 22, 1989 [KR] Rep. of Korea ..... 89-3605

[51] Int. Cl.[5] ..... H01J 29/54; H01J 29/56

[52] U.S. Cl. ..... 313/414; 313/447; 313/452

[58] Field of Search ..... 315/14; 313/414, 447, 313/452

[56] References Cited

U.S. PATENT DOCUMENTS 4,052,643 10/1977 Yamazaki et al. ..... 313/414
4,686,420 8/1987 Kamohara ..... 313/414

*Primary Examiner*—Donald J. Yusko
*Assistant Examiner*—Diab Hamadi
*Attorney, Agent, or Firm*—Morgan & Finnegan

[57] ABSTRACT

A multi-step focusing type electron gun is disclosed which includes a cathode, electrodes G1 and G2, and electrodes G3, G4, G5, G6, G7, and G8 for forming two unipotential auxiliary lenses and a bipotential major lens in the main lens, characterized in that the electrodes G4, G5, G6, G7 are so constituted as to satisfy some specific formulas. The electron gun can reduce the size of the beam spot and the size of the halo formed around the beam spot. Further the electron gun improves the spherical aberration, and provides the flexibility in designing for different purposes, as well as improving the image quality on the screen.

6 Claims, 4 Drawing Sheets

MULTISTEP FOCUSING ELECTRON GUN FOR CATHODE RAY TUBE

FIELD OF THE INVENTION

The present invention relates to an electron gun for use in a cathode ray tube, and particularly to a multistep focusing electron gun in which the main lens means consists of two unipotential type auxiliary lenses and a bipotential type major lens.

BACKGROUND OF THE INVENTION

The image quality of a cathode ray tube greatly depends on the performance of the electron gun, and especially, the focus characteristic of electron beams made by means of an electron gun is an important factor which directly affects the image quality. That is, a good electron gun will form the smallest beam spots as far as possible with low spherical aberration, and such an electron gun having the above mentioned purposes has been developed in various types. Among them, there is one in which, in order to reduce the spherical aberration, the beam passing holes of the main lens are overlapped in such a manner that three beam passing holes should be continuously formed. But in this type, if the beam current is increased, then the spherical aberration may be increased. In order to settle said apprehension, the length of the electrode G3 has to be increased enough for the magnification of the main lens to be reduced. However, such case, there is a problem of practicability.

In consideration of these circumstances, Korean Patent publication No. 87-281 discloses an improved electron gun based on a new conception, which is characterized in that the spherical aberration can be reduced to a great degree by providing two unipotential type auxiliary lenses at a position upstream of the bipotential type major lens. That is, the electron beam which had been focused by means of a single main lens in the preceeding technology has come to be focused through two auxiliary lenses and a major lens. Such a dispersion of the focusing steps over three lenses is for reducing the spherical aberration by means of low magnification lenses. That is, while the beam is focused by a multistep mechanism, the distance of the virtual object point (the starting point of the beam) is separated farther from the screen step by step, so that the incident angles of the electron beam relative to the respective lenses should be reduced step by step.

The electron gun based on the above described principle provided a satisfactory performance to a certain extent, but in order to obtain the maximum performance, the dimensions of the components and voltages applied to them should be more thoroughly deliberated.

SUMMARY OF THE INVENTION

Therefore it is an object of the present invention to provide a multistep focusing electron gun for cathode ray tube in which the spherical aberration and the focus characteristics are greatly improved.

It is another object of the present invention to provide a multistep focusing electron gun for cathode ray tube in which the size of the beam spot can be easily adjusted, thereby making it possible to design it as a multipurpose electron gun.

To achieve the said objects, the present invention provides a multi-step focusing type electron gun comprising an electron beam producing cathode K, a control grid G1, a screen grid G2 and electrodes G3, G4, G5, G6, G7, and G8 for forming two unipotential auxiliary lenses and a bipotential major lens in the main lens means. Further, the electrodes G4, G5, G6 and G7 are designed such that they should satisfy the following formulas:

$$0.18 \leqq \frac{L4}{D4} \leqq 0.55$$

$$0.36 \leqq \frac{L5}{D5} \leqq 1.45$$

$$0.07 \leqq \frac{L6}{D6} \leqq 0.18$$

$$1.09 \leqq \frac{L7}{D7} \leqq 1.73$$

where D4, D5, D6 and D7 indicate the diameters of the beam passing holes of the electrodes G4, G5, G6 and G7, respectively, and L4, L5, L6 and L7 the lengths of them, respectively.

BRIEF DESCRIPTION OF THE DRAWINGS

The above objects and other advantages of the present invention will become more apparent by describing in detail the preferred embodiments of the present invention with reference to the attached drawings in which.

DESCRIPTION OF THE PREFERRED EMBODIMENTS

Figure 1:
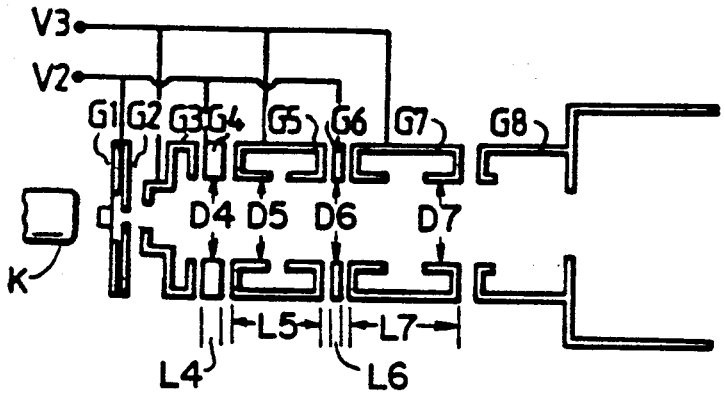
FIG. 1 is a schematic sectional view of the first embodiment of the present invention.

Referring to FIG. 1 in which the first embodiment of the electron gun according to the present invention is illustrated, this drawing shows a beam producing cathode K, a control grid G1, a screen grid G2, and electrodes G3, G4, G5, G6, G7, and G8. The electrodes are accelerating and focusing the electron beam from the said cathode, control grid G1, and screen grid G2. All of the electrodes are arranged at proper intervals.

Here, the general dimensions of the said electrodes are determined by the relationship between the diameters of the beam passing holes of the respective electrodes and the lengths of their bodies as shown in Table 1 below. The inventor obtained the values of Table 1 through repeated numeric analysis experiments.

TABLE 1

| Length of electrodes/ diameters of holes | L4/D4 | L5/D5 | L6/D6 | L7/D7 |
|---|---|---|---|---|
| Ranges | 0.18–0.55 | 0.36–1.45 | 0.07–0.18 | 1.09–1.73 |

In the above table, L4, L5, L6 and L7 indicate the lengths of the electrodes G4, G5, G6 and G7, while D4, D5, D6 and D7 indicate the diameters of the beam passing holes of the respective electrodes.

Of the said electrodes, the lengths of the electrodes placed in the main lens means may be variable within the allowable ranges as shown in Table 2 below, depending on the application and other conditions of the electron gun, but assuming that all the beam passing holes have a uniform diameter of 5.5 mm.

TABLE 2

| | G4 | G5 | G6 | G7 |
|---|---|---|---|---|
| Lengths | 1.0–3.0 | 2.0–8.0 | 0.4–1.0 | 6.0–9.5 |

In the said main lens means, the electrodes G4, G5, G6 and G7 forming an auxiliary lens should preferably have narrow intervals between the adjacent ones, preferably 0.6 mm, while the interval between the electrodes G7, and G8 may be desirably about 1.0 mm.

The electrodes G1, G2 form electron beams in cooperation with the cathode which is positioned upstream of the said electrodes G1, G2, forming a three-electrode tube portion, and these electrodes G1, G2 should be designed in the normal type or properly depending on the application of the electron gun. The electrode G3 should also be based on the normal type, but the diameter of the outgoing side of the beam passing hole of this electrode may be formed in a size smaller than that of the electrode G4 properly in different embodiments.

Figure 8:
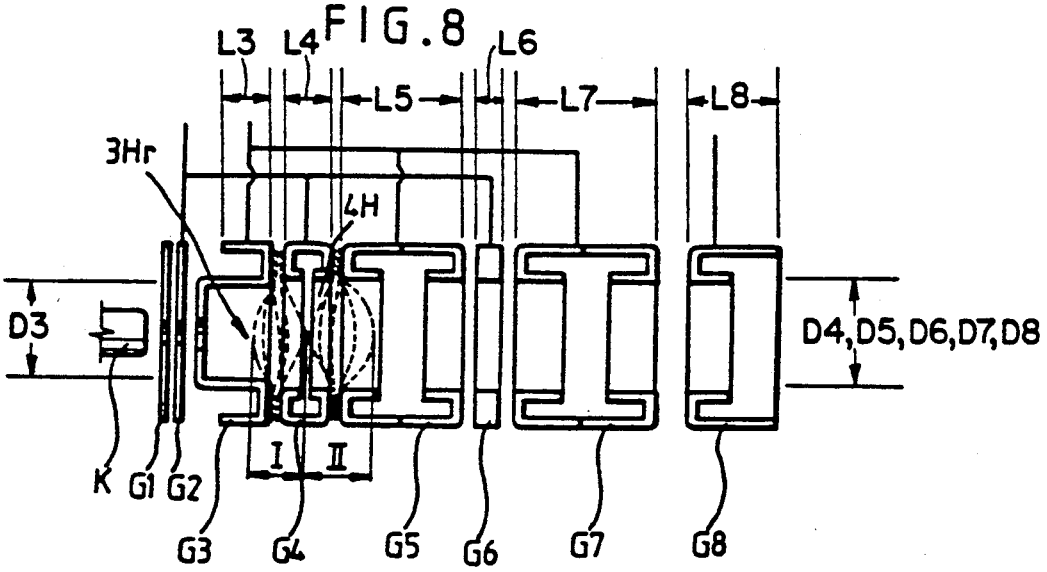
FIG. 8 is a schematic sectional view of the second embodiment of the electron gun according to the present invention.

That is, as shown in the second embodiment of the present invention illustrated in FIG. 8, the outgoing side beam passing hole 3H*r* of the electrode G3 can be formed in a size smaller than the beam passing holes of the electrodes G4, G5, G6, G7, and G8, all of which have holes having the same diameter.

Figure 9:
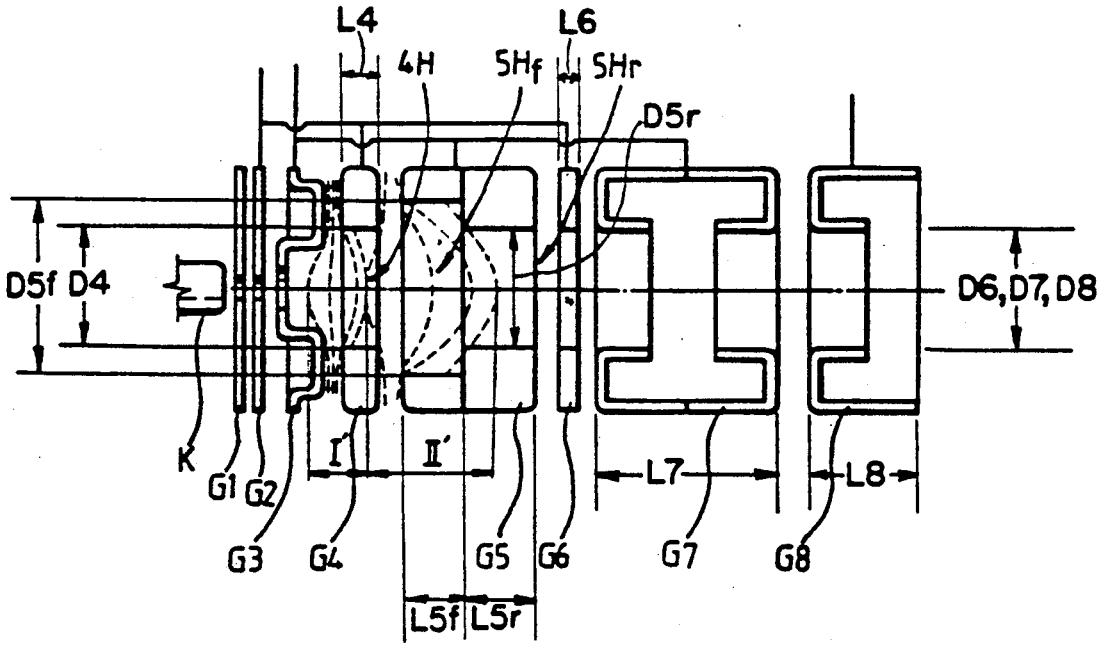
FIG. 9 is a schematic sectional view of the third embodiment of the electron gun according to the present invention.

Further, referring to FIG. 9 which illustrates the third embodiment of the present invention, the incident side beam passing hole 5H*f* of the electrode G5 has a larger diameter, unlike the beam passing hole 4H of the electrode G4 and the outgoing side beam passing hole 5H*r* of the electrode G5, both of which have a same diameter.

Therefore, the diameters of the beam passing holes of the respective electrodes should satisfy the following formulas:

$$D3r < D4 < D5f, \quad D4 = D5r$$

where D3*r* indicates the diameter of the outgoing beam passing hole of the electrode G3, D4 the diameter of the beam passing hole of the electrode G4, and D5*f* the diameter of the incident side beam passing hole of the electrode G5. Of course, the above electrodes should come within the ranges specified in Table 1.

In the embodiments of the present invention described above, the proportion of the applied focus voltage Vf to the anode voltage Eb should fall approximately within the range of 23%–34%, and the most desirable focus voltage Vf and anode voltage Eb are, respectively, 7 KV and 25 KV in the case of a 20-inch cathode ray tube.

The above specified dimensions of the multistep focusing electron gun according to the present invention are the values obtained as a result of repeated experiments, and should apparently produce a satisfactory result.

Figure 2:
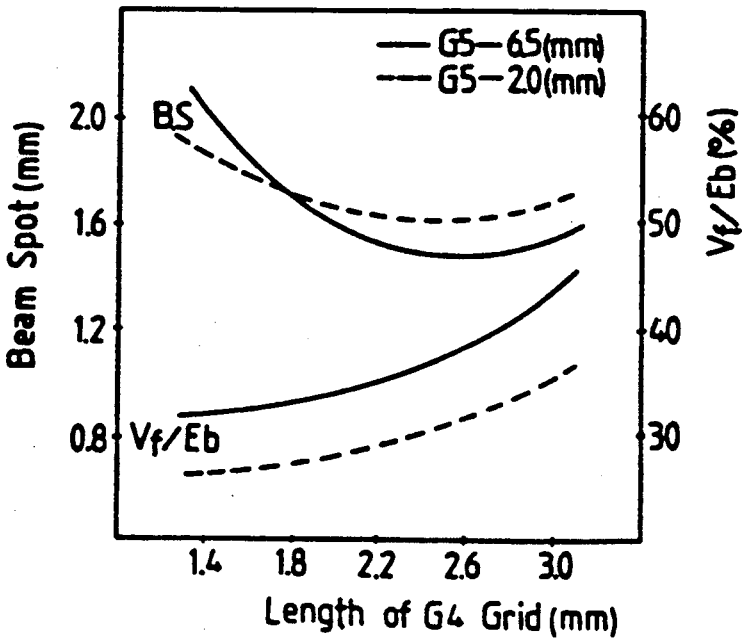
FIG. 2 is a graphical illustration showing the characteristics of the first unipotential lens of the main lens means of the electron gun according to the present invention, the values being obtained by a numeric control method.

First, the variations of the performances of the multistep focusing electron gun in correspondence with the variations of the sizes of the electrodes as abtained through the experiments will be described. FIG. 2 shows the variations of the size of the beam spot as against the variations of the lengths L4, L5 of the electrodes G4, G5, and the variations of the ratio of the focus voltage Vf to the anode voltage Eb as against the variations of the lengths of the electrodes G4, G5 for the first embodiment of the present invention. That is, in the case where the electrode G4 has a length of 1.4 mm, and the length of the electrode G5 is varied within the range of 2.0–6.5 mm, Vf/Eb falls within the range of 23%–34%, and the variation of the beam size falls within the range of 1.8–2.1 mm approximately.

Figure 3:
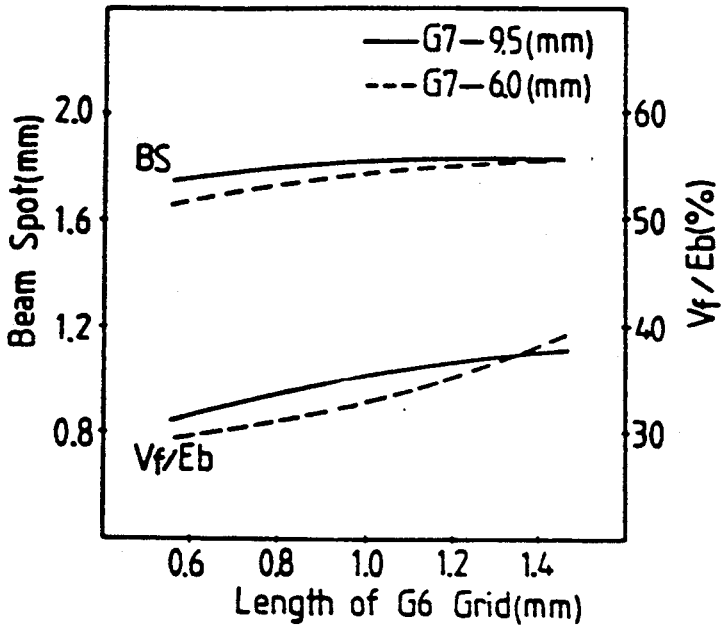
FIG. 3 is a graphical illustration showing the characteristics of the second unipotential lens of the main lens means of the electron gun according to the present invention, the values being obtained by a numeric control method.

Further, as shown in FIG. 3, if the length of the electrode G6 is 0.6 mm, and the length of the electrode G7 facing with the said electrode G6 opposingly is varied within the range of 6.0–9.5 mm, then the value of Vf/Eb is varied within the range of 30–32%, and the size of the beam spots will stay in the range of 1.65–1.70 mm.

Figure 4:
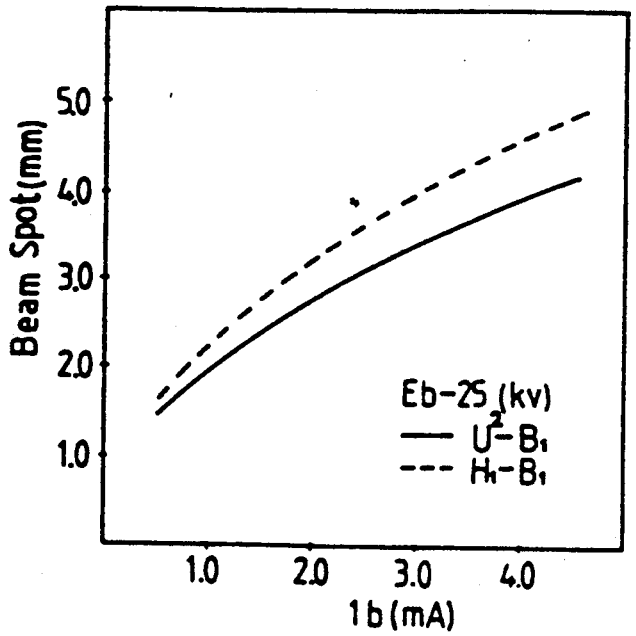
FIG. 4 is a graphical illustration comparatively showing the beam spot size-cathode currents for the electron gun of the present invention and that of the conventional technology.
Figure 5:
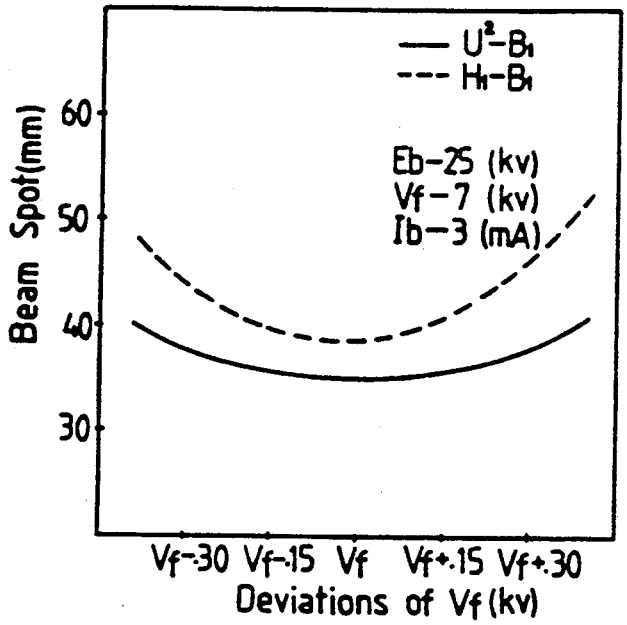
FIG. 5 is a graphical illustration comparatively showing the variations of the beam spots in correspondence with the variations of the focusing voltages for the electron gun of the present invention and that of the conventional technology.

The electron gun according to the present invention having such a characteristic and the conventional electron gun are compared in FIG. 4 which shows that the electron gun according to the present invention forms a smaller beam spot compared with the conventional electron gun Hi-Bi, on the assumption that the cathode current Ib is the same in both of them. Especially, to see into the variations of the beam spot as against the variations of the focus voltage Vf as shown in FIG. 5, the electron gun according to the present invention forms a far smaller beam spot, and its variation range is also smaller under the same focus voltage applied.

Figure 6:
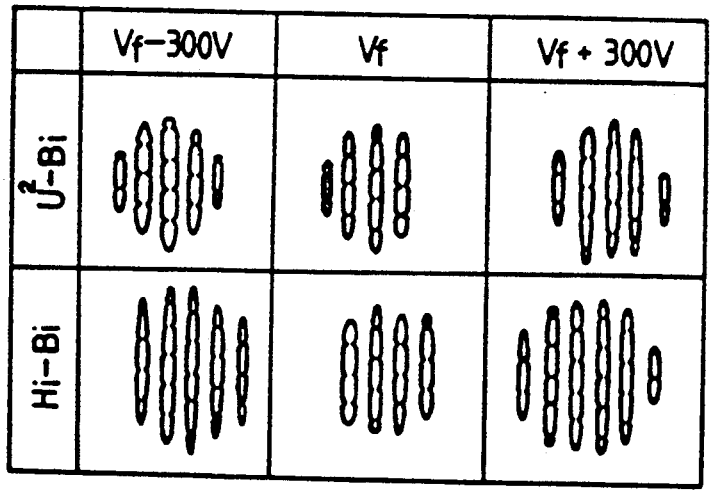
FIG. 6 is an enlarged view of the beam spot of the electron gun of the present invention and that of the conventional electron gun.

Further, as shown in FIG. 6, the electron gun according to the present invention forms a smaller beam spot, and shows a smaller variation range compared with the conventional electron gun.

Figure 7:
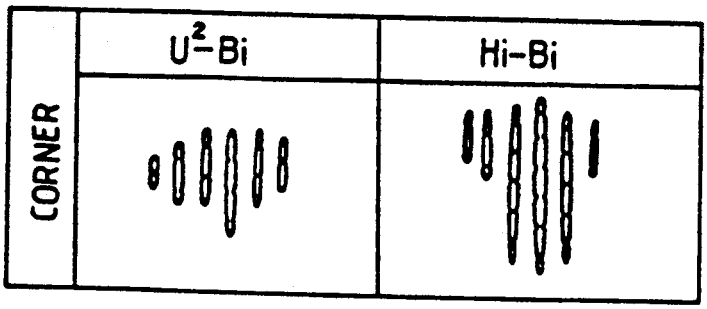
FIG. 7 is an enlarged view of the beam spots comparatively showing the characteristics of the beam spots appearing in the peripheral zones of the screen for the electron gun of the present invention and that of the conventional technology.

Further, as shown in FIG. 7, the focus characteristics on the peripheral areas of the screen is also improved in the electron gun of the present invention compared with the conventional electron gun. The conventional electron gun shows not only a larger beam spot, but also forms a larger halo around the beam spot, whereas the electron gun according to the present invention produces a smaller halo and a smaller beam spot.

Meanwhile, according to the second and third embodiments of the present invention which are illustrated in FIGS. 8 and 9, respectively, the characteristics of the electron gun are further improved. That is, not only the spherical aberration is further improved, but also, an excellent focus characteristics is produced.

In other words, in the second embodiment illustrated in FIG. 8, an electrostatic unipotential lens is formed by means of the electrodes G3, G4, G5 and a weak diverging section I is formed by the combination of the electrode G3 having an outgoing side beam passing hole 3H*r* of a smaller diameter, and the electrode G4 having a beam passing hole 4H of a larger diameter. Accordingly, when the electron beam is passing the section I, the electron beam experiences a weak diverging force, with the result that the electron beam enters with a smaller incident angle into the focusing section II which is formed by the cooperation between the electrodes G4, G5. As a result, the spherical aberration on the screen surface of the cathode ray tube is improved, resulting in that clear and high quality images are produced on the screen.

Meanwhile, the third embodiment of the present invention as illustrated in FIG. 9 has a more advanced constitution compared with the second embodiment. Here, the beam passing hole of the electrode G5 forming a part of a beam focusing section II′ is formed in a smaller size compared with the beam passing holes of the electrodes G4, and G6, which are disposed at the opposite sides thereof, thereby producing a strong focusing force. Electrode G5 comprises front and rear beam passing sections having beam passing holes 5H*f* and 5H*r* and corresponding beam passing diameters D5*f*, D5*r* and lengths L5*f* and L5*r*.

Therefore, in this embodiment, the beam diverging force is weakened through the diverging section I′, while the beam focusing force is reinforced through the focusing section II′. Consequently, the spherical aberration is greatly reduced, and the beam focus characteristics is markedly improved compared with the above embodiments.

In short, the electron gun according to the present invention has the following advantages. The variations of the size of the image as against the variations of the magnification of the main lens and against the variations of the distance to the screen are reduced, while the spherical aberration most greatly affecting the pattern of the beam is remarkably improved, because the beam divergence angle can be easily adjusted by means of the auxiliary lenses.

Thus, the electron gun according to the present invention reduces the size of the beam spot by about 30% compared with the conventional electron guns, thereby making it suitable for use in a cathode ray tube of a high fineness and high resolution. Moreover the astigmatism in the peripheral areas is remarkably improved, thereby making it possible to improve the image quality.

Further, the first and second auxiliary lenses are provided in an adjustable form in their magnifications, thereby providing flexibilities in designing them for different purposes. Moreover the voltage differences between the electrodes can be minimized compared with the conventional electron guns, thereby improving the voltage resistance characteristics.

What is claimed is:

1. A multi-step focusing type electron gun, comprising: a cathode; a control grid; a screen grid; and a plurality of electrodes including third, fourth, fifth, sixth, seventh and eighth electrodes each having beam passing holes for forming two unipotential auxiliary lenses and a bipotential major lens, the improvement being that said fourth, fifth, sixth and seventh electrodes are constituted according to the following formulas:

$$0.18 \leqq \frac{L4}{D4} \leqq 0.55$$

$$0.36 \leqq \frac{L5}{D5} \leqq 1.45$$

$$0.07 \leqq \frac{L6}{D6} \leqq 0.18$$

$$1.09 \leqq \frac{L7}{D7} \leqq 1.73$$

where D4, D5, D6 and D7 indicate, respectively, the diameters of the beam passing holes of the fourth, fifth, sixth and seventh electrodes, and L4, L5, L6 and L7 indicate the lengths thereof respectively.

2. The multi-step focusing type electron gun as claimed in claim 1, wherein the diameter of the outgoing side beam passing hole of said third electrode is formed in a size smaller than that of the beam passing hole of the fourth electrode.

3. The multi-step focussing type electron gun as claimed in claims 1 or 2, wherein the diameter of the incident side beam passing hole of said fifth electrode is formed in a size larger than the diameters of the beam passing hole of said fourth electrode which are positioned at the opposite sides thereof.

4. A multi-step focusing type electron gun for focusing an electron beam comprising: a cathode for producing electrons; control and screen grids for forming an electron beam; and a plurality of electrodes each having a beam passing hole to focus and accelerate said electron beam, wherein said plurality of electrodes include first through fourth electrodes having respective lengths L1, L2, L3, and L4 and respective diameters of beam passing holes D1, D2, D3, and D4, and wherein the ratio of the electrode length to diameter is, respectively, for each electrode, $$0.18 \leqq \frac{L1}{D1} \leqq 0.55$$

$$0.36 \leqq \frac{L2}{D2} \leqq 1.45$$

$$0.07 \leqq \frac{L3}{D3} \leqq 0.18$$

$$1.09 \leqq \frac{L4}{D4} \leqq 1.73.$$

5. The system according to claim 4, in which the diameter of the outgoing side beam passing hole of the first electrode is smaller than the diameter of the beam passing hole of the second electrode.

6. The system according to claim 4, in which the diameter of the incident side beam passing hole of said third electrode is larger than the diameters of the beam passing hole of said second electrode and the outgoing side beam passing hole of said third electrode.

* * * * *